US008212764B2

(12) United States Patent
Song et al.

(10) Patent No.: US 8,212,764 B2
(45) Date of Patent: Jul. 3, 2012

(54) LIQUID CRYSTAL DISPLAY AND DRIVING METHOD THEREOF

(75) Inventors: Hong Sung Song, Gyeongsanbuk-do (KR); Byung Jin Choi, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 1348 days.

(21) Appl. No.: 11/895,520

(22) Filed: Aug. 24, 2007

(65) Prior Publication Data

US 2008/0117162 A1 May 22, 2008

(30) Foreign Application Priority Data

Nov. 21, 2006 (KR) ..... 10-2006-115150

(51) Int. Cl.
*G09G 3/36* (2006.01)

(52) U.S. Cl. ..... 345/102; 345/211

(58) Field of Classification Search ..... 345/102, 345/211

See application file for complete search history.

(56) References Cited

U.S. PATENT DOCUMENTS

| | | | | |
|---|---|---|---|---|
| 6,762,741 | B2 * | 7/2004 | Weindorf | 345/102 |
| 2004/0257329 | A1 * | 12/2004 | Park et al. | 345/102 |

FOREIGN PATENT DOCUMENTS

| | | |
|---|---|---|
| DE | 69231601 T2 | 4/2001 |
| JP | 09-005710 | 1/1997 |
| JP | 10-74376 | 3/1998 |
| JP | 11-66753 | 3/1999 |
| JP | 2000-13723 | 1/2000 |
| JP | 2000-306327 | 11/2000 |
| JP | 2001-249694 | 9/2001 |
| JP | 2002-158965 | 5/2002 |
| JP | 2002-158972 | 5/2002 |
| JP | 2003-18549 | 1/2003 |
| JP | 2004-177547 | 6/2004 |
| JP | 2004-354882 | 12/2004 |
| WO | WO 2006112170 A1 | 10/2006 |

OTHER PUBLICATIONS

Office Action issued in corresponding Japanese Patent Application No. 2007-262042, mailed Oct. 22, 2010.

Office Action issued in corresponding German Patent Application No. 10 2007 040 378.1, mailed Aug. 12, 2010.

* cited by examiner

*Primary Examiner* — Ke Xiao

(74) *Attorney, Agent, or Firm* — Brinks Hofer Gilson & Lione

(57) ABSTRACT

In one embodiment, a driving method for a liquid crystal display device having a backlight is provided. Input digital video data is analyzed and an adaptive brightness control signal is generated based on a brightness analysis of the input digital video data. An external brightness control signal is received via a user interface. A plurality of brightness control voltages is generated based on the adaptive brightness control signal. The plurality of brightness control voltages represents different brightness levels. One of the brightness control voltages is selected in response to the external brightness control signal. The backlight operates according to the selected brightness control voltage.

14 Claims, 5 Drawing Sheets

100
111
SYSTEM
Ri,Gi,Bi
112
FIRST PROCESSOR
R0,G0,B0
Vsync2
Hsync2
DCLK2
DE2
Vsync1
Hsync1
DCLK1
DE1
113
TIMING CONTROLLER
R0,G0,B0
DDC
GDC
114
GAMMA VOLTAGE SUPPLYING CIRCUIT
115
DATA DRIVING CIRCUIT
D1
Dm
116
TFT
Clc
Cst
G0
G1
Gn
117
GATE DRIVING CIRCUIT
118
BACKLIGHT
119
DC-DC CONVERTER
VDD
VGH, VGL
VCOM
VCC
Al-Vbr
120
INVERTER
C-Vbr
122
SECOND PROCESSOR
Vinv
121
USER INTERFACE
Ext-Vbr

LIQUID CRYSTAL DISPLAY AND DRIVING METHOD THEREOF

PRIORITY CLAIM

This application claims the benefit of Korean Patent Application No. P2006-115150 filed in Korea on Nov. 21, 2006, which is hereby incorporated by reference.

BACKGROUND OF THE INVENTION

1. Technical Field

The present invention relates to a liquid crystal display and a driving method, and more particularly to a liquid crystal display and a driving method that adaptively controls the brightness of a backlight.

2. Description of the Related Art

Liquid crystal display devices control a light transmittance of liquid crystal cells in accordance with a video signal and display a picture. Liquid crystal display devices having a switching device formed at each cell are referred to as an active matrix type.

FIG. 1 schematically shows a liquid crystal display device 10 of an active matrix type in the related art. In FIG. 1, the liquid crystal display device 10 includes a system 17, a liquid crystal display panel 15, a backlight 16, a data driving circuit 13, a gate driving circuit 14, a timing controller 12, an interface circuit 11, a DC-DC converter 18, and an inverter 19. The system 17 includes an electronic device which uses the liquid crystal display device 10 for a display. The liquid crystal display panel 15 has m×n number of liquid crystal cells Clc which are arranged in a matrix type, m number of data lines D1 to Dm and n number of gate lines G1 to Gn which cross each other, and a thin film transistor (hereinafter, referred to as "TFT") which is formed at the crossing.

The backlight 16 irradiates a light to the liquid crystal display panel 15. The data driving circuit 13 supplies data to the data lines D1 to Dm of the liquid crystal display panel 15. The gate driving circuit 14 supplies a scanning pulse to the gate lines G1 to Gn. The timing controller 12 controls the data driving circuit 13 and the gate driving circuit 14. The interface circuit 11 is connected between the system 17 and the timing controller 12. The DC-DC converter 18 generates driving voltages of the liquid crystal display panel 15. The inverter 19 drives the backlight 16.

The liquid crystal display panel 15 has a liquid crystal formed between two glass substrates. On the lower glass substrate of the liquid crystal display panel 15, the data lines D1 to Dm and the gate lines G1 to Gn intersect each other. Each intersection between the data lines D1 to Dm and the gate lines G1 to Gn is provided with the TFT. The TFT supplies data on the data lines D1 to Dm to the liquid crystal cell Clc in response to a scanning pulse from the gate lines G1 to Gn. To this end, the gate electrode of the TFT is connected to the gate lines G1 to Gn while the source electrode of the TFT is connected to the data line D1 to Dm. Further, the drain electrode of the TFT is connected to the pixel electrode of the liquid crystal cell Clc.

A graphic processing circuit of the system 17 converts an analog data into digital video data RGB and, at the same time adjusts a resolution and a color temperature of the digital video data RGB. The digital video data RGB is supplied, via the interface circuit 11, to the timing controller 12.

The interface circuit 11 may use a TMDS (Transition Minimized Differential Signal) method or a LVDS (Low Voltage Differential Signaling) method. The TMDS method converts a digital video data into a TTL level or a CMOS level and transmits the converted video data in parallel. The LVDS method compresses the digital video data RGB in serial data, transmits the compressed serial data and then restores the compressed serial data to parallel data. Accordingly, a frequency and a voltage of the digital video data RGB may be smaller, and the number of signal line that transmits the digital video data RGB also may be reduced.

FIG. 2 illustrates a backlight control method using an average brightness of input digital video data RGB for use with the liquid crystal display device 10. The average brightness of digital video data RGB for each frame unit is calculated and the brightness of the backlight 16 is controlled in accordance with the average brightness. As a brightness range of an image signal increases, the liquid crystal display device 10 may produce a clear image by use of the backlight control as shown in FIG. 2.

The liquid crystal display device 10 depends solely on the average brightness of the input digital video data RGB to adjust the brightness of the backlight 16 and realize a clear image. The liquid crystal display device 10 may not substantially consider picture quality perception of a user in accordance with a change of an external environment, and an image property.

For instance, a user may perceive the contrast of an image differently due to a change of the external illumination. When the external illumination is low, although the backlight 16 is less bright than the average brightness of input digital video data RGB, a user may perceive that the contrast of the image is high. On the contrary, when the external illumination is high, the brightness of the backlight 16 should be brighter than the average brightness of input digital video data RGB and a user perceives the image as having a high contrast. Accordingly, information on the average brightness of the input digital video data RGB alone may not allow for an accurate evaluation of an image contrast.

Additionally, a preference for a certain level of contrast may be different depending upon the type of an image. For instance, an image corresponding to sports such as tennis normally may require a higher contrast than an image corresponding to movies. However, a certain user may prefer to watch the movies with higher contrast. Accordingly, there is a need for a liquid crystal display device that overcomes drawbacks of the related art.

SUMMARY

By way of example, in one embodiment, a method for driving a liquid crystal display device having a backlight is provided. A brightness component and color difference components are calculated based on digital video data. A histogram distribution of the digital video data is calculated and analyzed using the brightness component. Brightness information is calculated based on the histogram distribution. The brightness information includes a minimum brightness, a maximum brightness and an average brightness. Am adaptive brightness control signal is generated based on backlight driving data representative of the brightness information. The backlight driving data includes a digital signal that controls a driving power, a driving voltage and a driving current of the backlight. A plurality of control voltages is generated using the adaptive brightness control signal and one of the control voltages is selectively output in response to an external brightness control signal.

In other embodiment, input digital video data is analyzed and an adaptive brightness control signal is generated based on a brightness analysis of the input digital video data. An external brightness control signal is received via a user interface. A plurality of brightness control voltages is generated based on the adaptive brightness control signal. The plurality of brightness control voltages represents different brightness levels. One of the brightness control voltages is selected in response to the external brightness control signal. The backlight is controlled by the selected brightness control voltage.

In a further embodiment, a liquid crystal display device includes a first processor, a second processor and an inverter. The first processor is operable to receive input video data and analyze brightness of the input video data. The first processor generates an adaptive brightness control voltage. The second processor is structured to generate a plurality of different brightness voltages based on the adaptive brightness control voltage. The different brightness voltages represent different brightness levels. The second processor selectively outputs one of the different brightness voltages in response to an external brightness control. The inverter is coupled to the second processor and a backlight, and the inverter drives the backlight in response to the selected brightness voltage.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
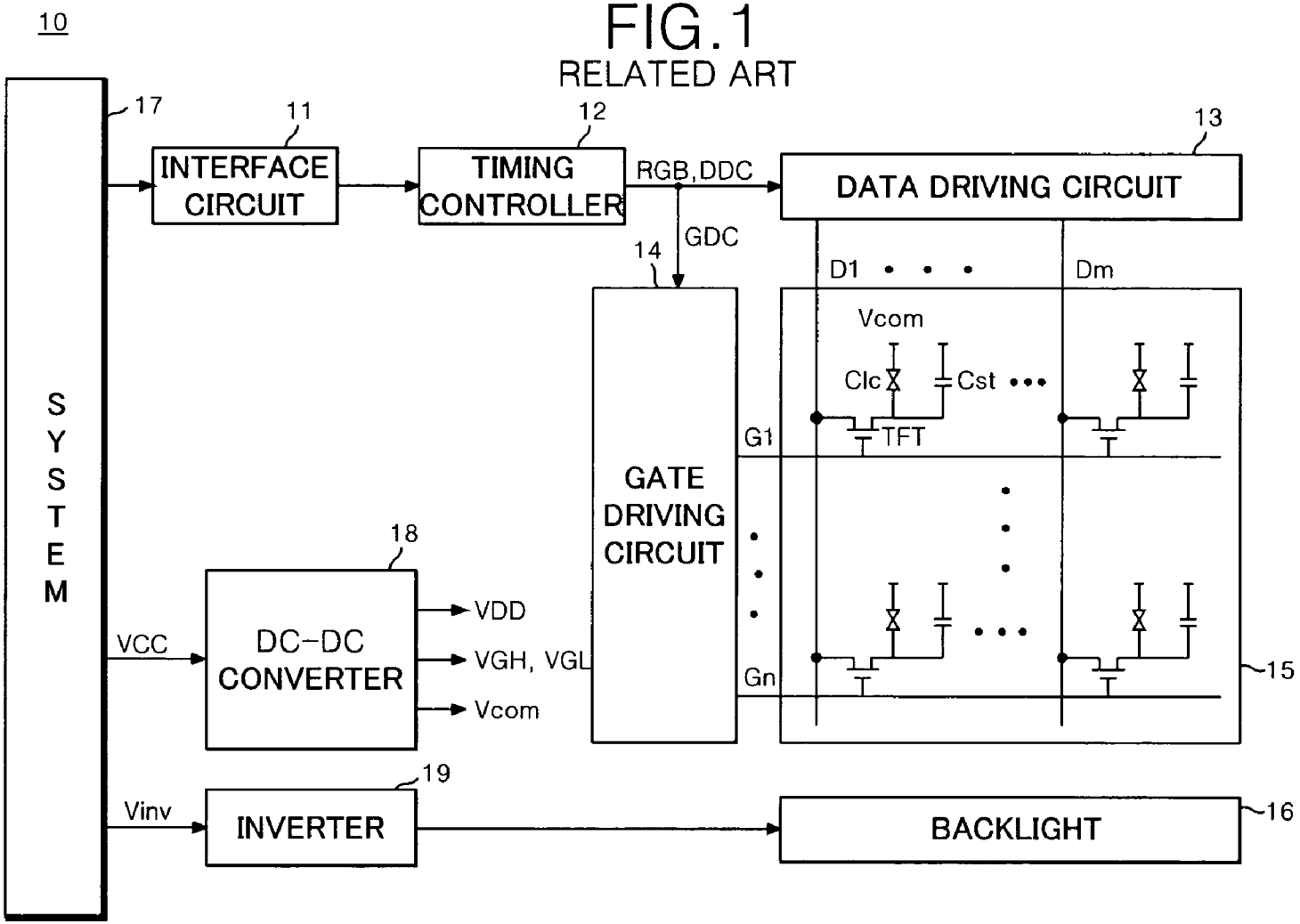
FIG. 1 RELATED ART
FIG. 1 is a block diagram showing a liquid crystal display device of the related art.
Figure 2:
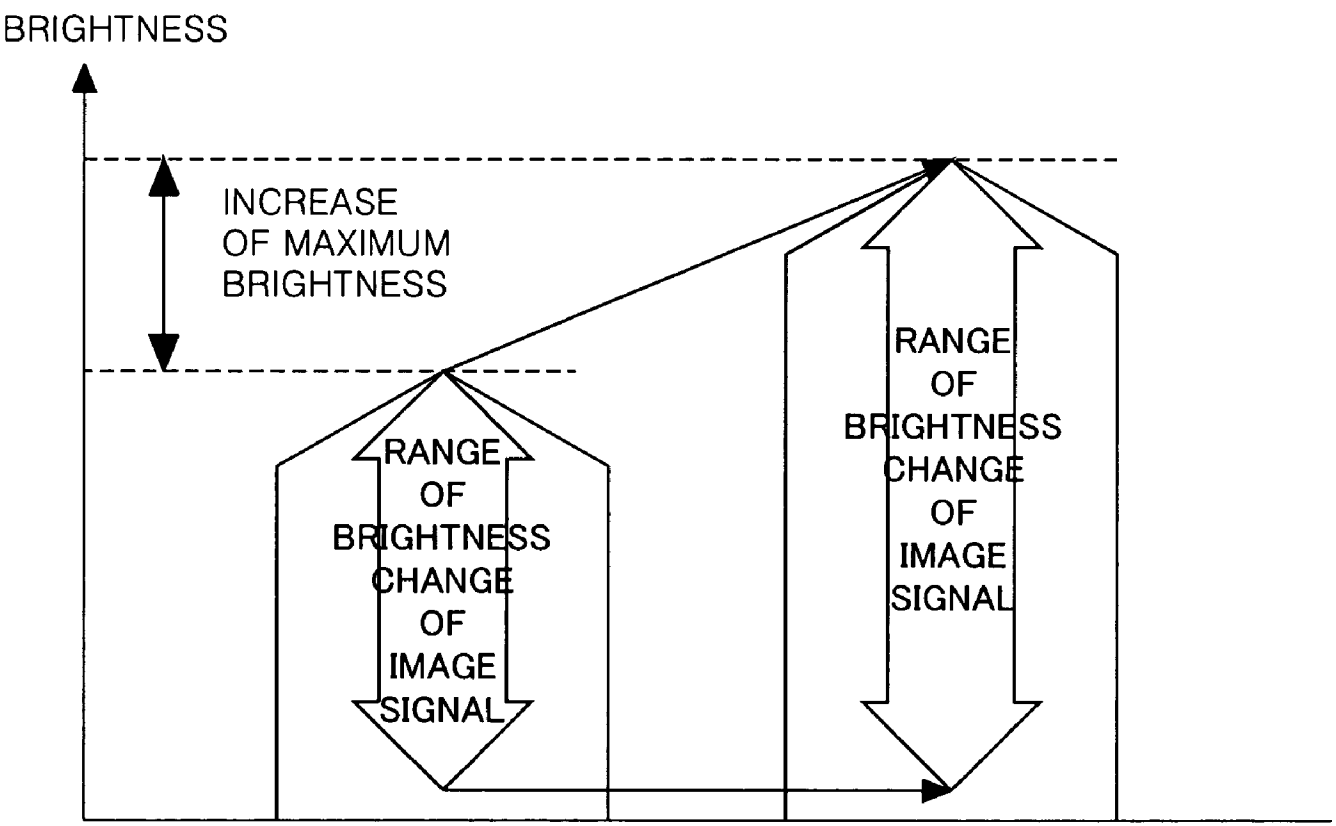
FIG. 2 RELATED ART
FIG. 2 is an illustration of a backlight control method for use with the liquid crystal display device of FIG. 1.
Figure 3:
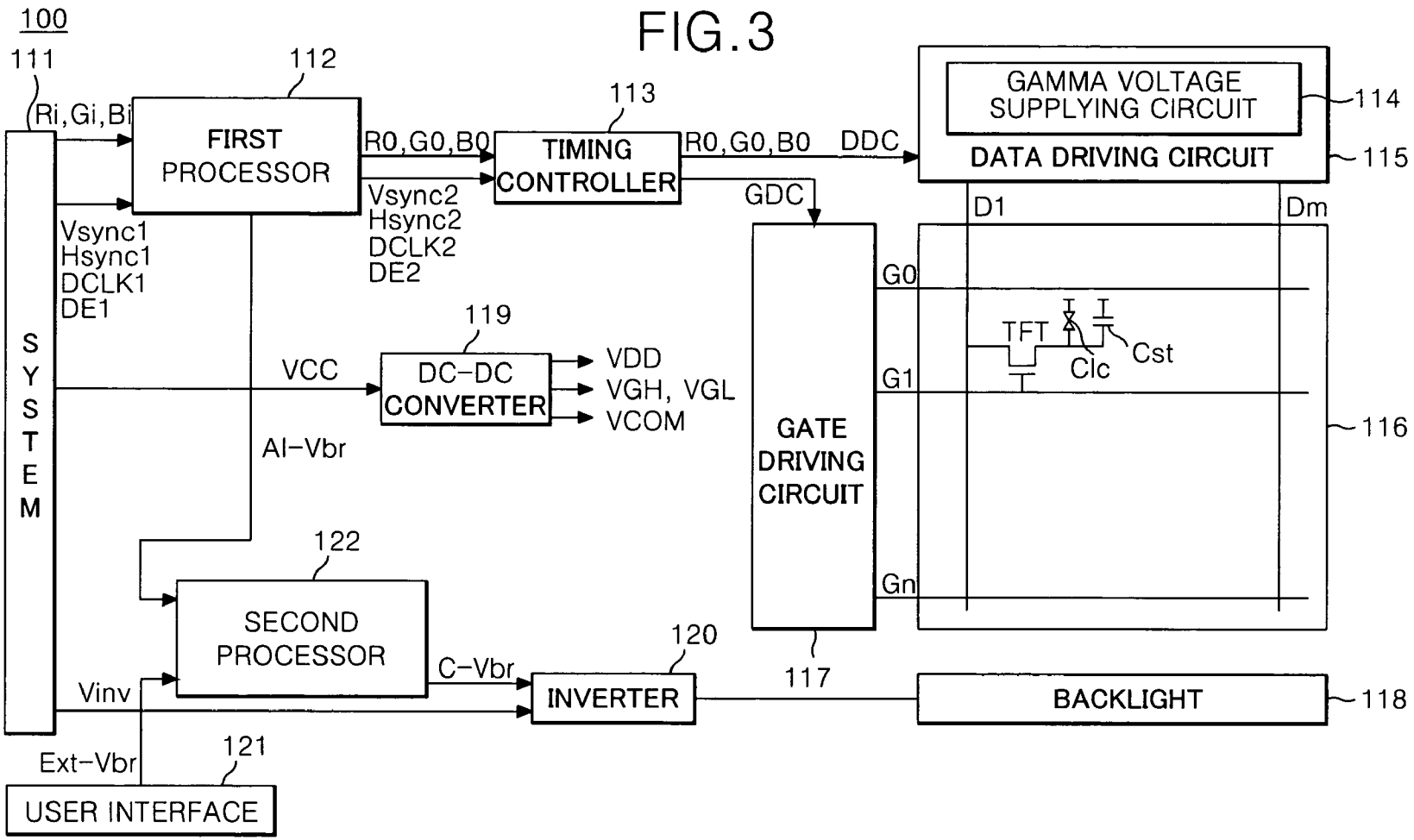
FIG. 3 is a block diagram showing a liquid crystal display according to one embodiment.

The preferred embodiments will be described in detail with reference to FIG. 3 to FIG. 5. FIG. 3 is a block diagram showing one embodiment of a liquid crystal display device 100. In FIG. 3, the liquid crystal display device 100 includes a first processor 112, a timing controller 113, a gamma voltage supplying circuit 114, and a data driving circuit 115. The liquid crystal display device 100 further includes a liquid crystal display panel 116, a gate driving circuit 117, a backlight 118, a DC-DC converter 119, and a second processor 122. The liquid crystal display panel 116 has m×n number of liquid crystal cells Clc which are arranged in a matrix type. There are m number of data lines D1 to Dm and n number of gate lines G1 to Gn intersecting each other, and a thin film transistor (hereinafter, referred to as "TFT") formed at the intersection.

In FIG. 3, the system 111 includes an electronic device that uses the liquid crystal display device 100 for a display. The system 111 provides digital video data of trichromatic, such as, 'Ri', 'Gi', and 'Bi' to the first processor 112. The system 111 includes a graphic processing circuit which converts analog data into the digital video data Ri, Gi, and Bi and, at the same time adjusts a resolution and a color temperature of the input digital video data Ri, Gi, and Bi. The first processor 112 modulates the digital video data 'Ri', 'Gi', and 'Bi' and outputs 'Ro', 'Go', and 'Bo' to the timing controller 113. The system 111 also provides timing signals to the first processor 112. The graphic processing circuit of the system 111 generates first vertical/horizontal synchronizing signals Vsync1 and Hsync1, a first clock signal DCLK1, and a first data enable signal DE1. The first clock DCLK1 samples digital video data, and the first data enable signal DE1 indicates a period of the digital video data Ri, Gi, and Bi, respectively. The first processor 112 modulates the timing control signals, Vsyn1, Hsyn1, DCLK1, and DE1 and generates additional timing signals, 'Vsyn2', 'Hsyn2', 'DCLK2', and 'DE2'.

The timing controller 113 supplies digital video data Ro, Go, and Bo to the data driving circuit 115. The timing controller generates control signals GDC and DDC that control the gate driving circuit 117 and the data driving circuit 115 using timing control signals Vsync2, Hsync2, DCLK2, and DE2. The control signal GDC of the gate driving circuit 117 includes a gate start pulse GSP, a gate shift clock GSC, and a gate output enable signal GOE, etc. The control signal DDC of the data driving circuit 115 includes a source start pulse SSP, a source shift clock SSC, a source output enable signal SOE, and a polarity signal POL, etc.

The data driving circuit 115 includes a gamma voltage supply circuit 114 which converts the digital video data Ro, Go, and Bo into an analog gamma compensation voltage in response to the control signal DDC. The data driving circuit 115 supplies the analog gamma compensation voltage to the data lines D1 to Dm of the liquid crystal display panel 116 as a data voltage. The gate driving circuit 117 generates a scanning pulse of gate voltages VGH and VGL in response to the control signal GDC and sequentially supplies the scanning pulse to the gate lines G1 to Gn to select a horizontal line of the liquid crystal display panel 116 to which a data signal is supplied.

A power supply (not shown) of the system 111 supplies a VCC voltage to the DC-DC converter 119, and supplies a DC input voltage Vinv to the inverter 120. The DC-DC converter 119 generates driving voltages of the liquid crystal display panel 116. The DC-DC converter 119 generates a VDD voltage, a VCOM voltage, a VGH voltage, and a VGL voltage using a VCC voltage which is inputted from the power supply of the system 111. The VCOM voltage is a voltage with which a common electrode of the liquid crystal cell Clc is supplied. The VGH voltage is a high logic voltage of a scanning pulse which is set to a voltage level greater than the threshold voltage of the TFT and is supplied to the gate driving circuit 117. The VGL voltage is a low logic voltage of a scanning pulse which is set as an off voltage of TFT and is supplied to the gate driving circuit 117. The gamma voltage supplying circuit 114 described above divides the VDD voltage and a VSS voltage which is set to the ground voltage GND and generates the analog gamma compensation voltages corresponding to each gray scale of the digital video data Ro, Go, and Bo.

The first processor 112 generates an adaptive brightness control signal Al-Vbr that can be used to modulate data and control the brightness of the backlight 118. The second processor 122 modifies the adaptive brightness control signal Al-Vbr from the first processor 112 and an external brightness control signal Ext-Vbr from a user interface 121 to control an inverter 120. The inverter 120 drives the backlight 118 to illuminate the liquid crystal display panel 116.

In generating the adaptive brightness control signal, the first processor 112 calculates a histogram distribution from input digital video data Ri, Gi, and Bi of the system 111, and then increases the histogram distribution and generates a modulated brightness component YM to modulate the input digital video data Ri, Gi, and Bi in accordance with the modulated brightness component YM. The first processor 112 modulates timing signals Vsync1, Hsync1, DCLK1, and DE1 from the system 111 to generate timing signals Vsync1, Hsync1, DCLK1, and DE1 which are synchronized with the modulated digital video data Ro, Go, and Bo. The first processor 112 generates the adaptive brightness control signal Al-Vbr on the basis of the analyzed result of the input digital video data Ri, Gi, and Bi and supplies the adaptive brightness control signal to the second processor 122.

The second processor 122 modifies the adaptive brightness control signal Al-Vbr from the first processor 112. The second processor receives an external brightness control signal Ext-Vbr from the user interface 121 and generates a composite brightness control signal C-Vbr. The composite brightness control signal C-Vbr controls a driving current, which is supplied from the inverter 120 to the backlight 118. The second processor 122 may be included in the system 111 or the inverter 121. The inverter 121 controls a driving power, a voltage, and a current of the backlight 118 in response to the composite brightness control signal C-Vbr from the second processor 122 to adjust brightness of the backlight 118. The structure and operations of the first processor 112 and the second processor 122 will be further described in detail below in conjunction with FIGS. 4 and 5.

The user interface 121 receives the external brightness control signal Ext-Vbr as a user input. The external brightness control signal Ext-Vbr is decoded by a decoder (not shown) to be converted into a signal that is capable of being processed at the second processor 122. Once converted, the external brightness control signal Ext-Vbr is supplied to the second processor 122. The decoder may be located at a front part of the second processor 122. The second processor 122 may reside in the system 111. Alternatively, the second processor 122 may reside in the inverter 120. The user interface 121 may be realized with any available interface: however, limited interfaces, i.e., an OSD (On Screen Display), a keyboard, a mouse, and a remote control, may not be used as the user interface 121.

Figure 4:
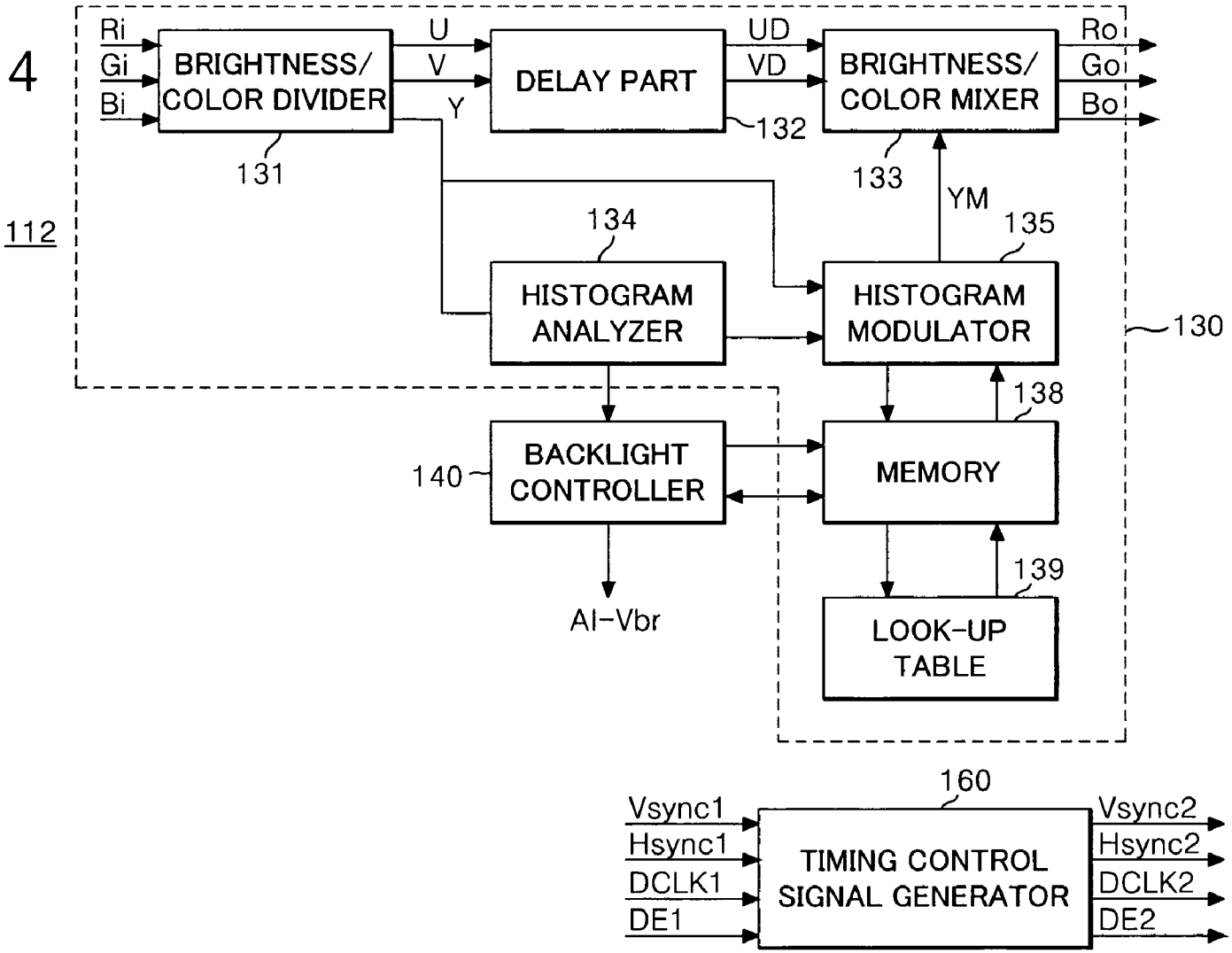
FIG. 4 is a block diagram showing the detailed structure of a first processor for use with the liquid crystal display device of FIG. 3.

FIG. 4 is a block diagram showing the detailed structure of the first processor 112 of FIG. 3. In FIG. 4, the first processor 112 includes an image signal modulator 130, a backlight controller 140, and a timing control signal generator 160. The image signal modulator 130 includes a brightness/color divider 131, a delay part 132, a brightness/color mixer 133, a histogram analyzer 134, a histogram modulator 135, a memory 138, and a look-up table 139. The image signal modulator 130 calculates a histogram distribution of the digital video data Ri, Gi, and Bi from the system 111, and then increases the histogram distribution. The image signal modulator 130 operates to modulate the digital video data Ri, Gi, and Bi in accordance with the increased histogram distribution.

The brightness/color divider 131 receives the digital video data Ri, Gi, and Bi and calculates a brightness component Y and color difference components U and V. The histogram analyzer 134 calculates and analyzes a histogram distribution for each frame using the brightness component Y. A brightness degree of an image is determined. The histogram analyzer 134 further calculates brightness information such as a minimum value of the brightness, a maximum value of the brightness, and an average brightness, etc based on the histogram distribution. The histogram analyzer 134 supplies the brightness information to the backlight controller 140 and the histogram modulator 135. The histogram modulator 135 reads a brightness component data of the look-up table 139 in accordance with the brightness information and generates a modulated brightness component YM. Based on the modulated brightness component YM, the histogram distribution of the digital video data Ri, Gi, and Bi and a contrast of an image may increase.

Due to the increase histogram distribution, low gray scale of the digital video data Ri, Gi, and Bi becomes lower and high gray scale of the digital video data Ri, Gi, and Bi becomes higher. The look-up table 139 includes the modulated brightness component YM and a backlight driving data. The modulated brightness component YM represents the brightness information. The backlight driving data represents the brightness information from the histogram analyzer 134. The memory 138 reads the modulated brightness component YM from the look-up table 139 upon request by the histogram modulator 135 or the backlight controller 140 and supplies it to the histogram modulator 135 or the backlight controller 140. The delay part 132 operates to delay processing of the color difference components U and V such that processing of the modulated brightness component YM and the color difference components U and V may be synchronized. The brightness/color mixer 133 generates the digital video data Ro, Go, and Bo that have the increased histogram distribution.

The backlight controller 140 reads the backlight driving data of the look-up table 139 from the memory 138 in accordance with the brightness information from the histogram analyzer 134. The backlight controller 140 generates the adaptive brightness control signal Al-Vbr. The adaptive brightness control signal Al-Vbr is a digital data that controls a driving power, a driving voltage, or a driving current of a backlight. The adaptive brightness control signal has a different duty ratio depending upon the brightness information.

The timing control signal generator 160 adjusts the timing signals Vsync1, Hsync1, DCLK1, and DE1 based on the digital video data Ro, Go, and Bo. The digital video data Ro, Go, and Bo have the increased histogram distribution and the timing signals Vsync2, Hsync2, DCLK2, and DE2 are synchronized with the digital video data Ro, Go, and Bo. In other embodiment, the timing control signal generator 160 may reside in the timing controller 113.

Figure 5:
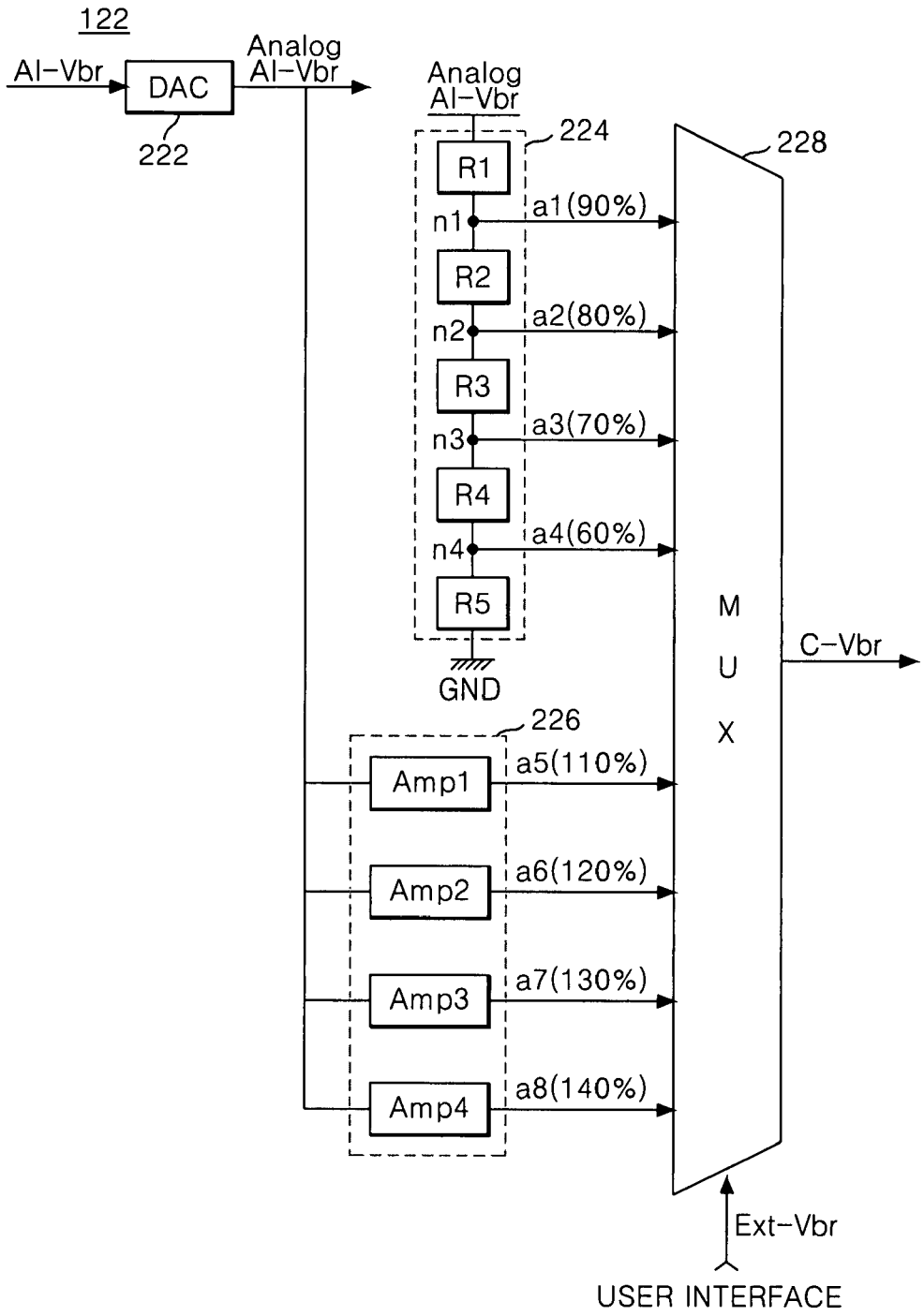
FIG. 5 is a block diagram showing the detailed structure of a second processor for use with the liquid crystal display device of FIG. 3.

FIG. 5 is a block diagram showing the detailed structure of the second processor 122. In FIG. 5, the second processor 122 includes a digital-analog converter 222 (hereinafter, referred to as "DAC"), a first brightness controller 224, a second brightness controller 226, and a multiplexer 228 (hereinafter, referred to as "MUX"). The DAC 222 digital-analog converts the adaptive brightness control signal Al-Vbr from the first processor 112 and supplies the converted signal to the first brightness controller 224 and to the second brightness controller 226.

The first brightness controller 224 reduces the adaptive-analog brightness control voltage Analog Al-Vbr which is supplied from the DAC 222 and supplies the voltage to the MUX 228. The first brightness controller 224 includes a resistor string which divides the adaptive-analog brightness control voltage Analog Al-Vbr into a plurality of voltages. A plurality of resistors is connected in series to one another. For example, the first brightness controller 224 divides the adaptive-analog brightness control voltage Analog Al-Vbr using a first to fifth resistors R1 to R5.

The first to fifth resistors R1 to R5 generate a first to fifth adaptive-analog brightness control voltages a1 to a4 which have a value lower than the adaptive-analog brightness control voltage Analog Al-Vbr. The first adaptive-analog brightness control voltage a1 is applied at a first node n1 voltage, the second adaptive-analog brightness control voltage a2 at a second node n2 voltage, the third adaptive-analog brightness control voltage a3 at third node n3 voltage, and the fourth adaptive-analog brightness control voltage a4 at a fourth node n4 voltage. Each value of the first to fifth resistances R1 to R5 is changeable, respectively. For instance, the first adaptive-analog brightness control voltage a1 may correspond to 90% of the adaptive-analog brightness control voltage Analog Al-Vbr by adjusting an adequate voltage value, the second adaptive-analog brightness control voltage a2 to 80%, the third adaptive-analog brightness control voltage a3 to 70% and the fourth adaptive-analog brightness control voltage a4 to 60%. In this embodiment, the resistors are used to modify the adaptive-analog brightness control voltage, but various other elements are available.

The second brightness controller 226 increases the adaptive-analog brightness control voltage Analog Al-Vbr and passes the modified brightness control voltage to the MUX 228. The second brightness controller 226 includes a plurality of amplifiers which amplifies the adaptive-analog brightness control voltage Analog Al-Vbr with a different amplification, respectively. For example, the second brightness controller 226 amplifies the adaptive-analog brightness control voltage Analog Al-Vbr using a first to fourth amplifiers Amp1 to Amp4. Each of the first to fourth amplifiers Amp1 to Amp4 has a different amplification and the first to fourth amplifiers Amp1 to Amp4 generate fifth to eighth adaptive-analog brightness control voltages a5 to a8 which have a value larger than the adaptive-analog brightness control voltage Analog Al-Vbr. The amplification of each of the first to fourth amplifiers Amp1 to Amp4 is changeable, respectively. The fifth adaptive-analog brightness control voltage a5 may increase to 110% of the adaptive-analog brightness control voltage Analog Al-Vbr by adjusting an adequate voltage value, the sixth adaptive-analog brightness control voltage a6 may increase to 120%, the seventh adaptive-analog brightness control voltage a7 may increase to 130%, and the eighth adaptive-analog brightness control voltage a8 may increase to 140%. In this embodiment, amplifiers are used but various other structures are available.

The MUX 228 selectively outputs one of the plurality of the adaptive-analog brightness control signals which are supplied from the first brightness controller 224 and the second brightness controller 226 in response to an external brightness control signal Ext-Vbr. The external brightness control signal Ext-Vbr controls a switching operation of the MUX 228 to output one of the plurality of the adaptive-analog brightness control signals. For example, the MUX 228 selects one of the first to eighth adaptive-analog brightness control voltages a1 to a8 in accordance with the decoded digital external brightness control signal of 3 bits, and outputs it as the composite brightness control signal C-Vbr. The user changes the external brightness control signal Ext-Vbr to output one of the first to fourth adaptive-analog brightness control voltages a1 to a4. A clear image may be realized without change of the contrast despite various user surroundings. For example, the clear image may be obtained without the increased contrast despite a low external illumination. Furthermore, the user can change the external brightness control signal Ext-Vbr to output one of the fifth to eighth adaptive-analog brightness control voltages a5 to a8 in the case where the contrast should increase to produce a clear image due to a high external illumination, or a high contrast as needed.

The composite brightness control signal C-Vbr is an analog signal, and is converted into a pulse width modulating signal PWM by an analog/PWM converter (not shown) within the inverter 120. The pulse width modulation signal PWM may adjust a driving current which is applied to a lamp of the backlight 118.

As described above, the liquid crystal display and the driving method change the contrast in accordance with the external brightness control signal by the user. Additionally, the contrast may be determined further based on the average brightness of input digital video data. Accordingly, power consumption may be reduced, the contrast may improve, and a preference of the user may be satisfied.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

We claim:

1. A method for driving a liquid crystal display device having a backlight, comprising:

calculating a brightness component and color difference components based on digital video data;

calculating and analyzing a histogram distribution of the digital video data using the brightness component;

calculating brightness information based on the histogram distribution, the brightness information including a minimum brightness, a maximum brightness and an average brightness;

generating a digital adaptive brightness control signal based on backlight driving data representative of the brightness information, the backlight driving data including a digital signal that controls a driving power, a driving voltage and a driving current of the backlight;

converting the digital adaptive brightness control signal into a analog adaptive brightness control signal;

decreasing the analog adaptive brightness control signal to generate a plurality of low brightness control voltages, the low brightness control voltages being different from one another;

increasing the analog adaptive brightness control signal to generate a plurality of high brightness control voltages, the high brightness control voltages being different from one another; and selectively outputting one of the low brightness control voltages and the high brightness control voltages in response to an external brightness control signal.

2. The method of claim 1, wherein the low brightness control voltages are smaller than the analog adaptive brightness control signal.

3. The method of claim 1, wherein the the high brightness control voltages are larger than the analog adaptive brightness control signal.

4. The method of claim 1, further comprisinq:

driving the backlight according to the selected brightness control voltage.

5. A liquid crystal display device, comprising:

a first processor operable to calculate a brightness component and color difference components based on digital video data, calculate and analyze histogram distribution of the digital video data using the brightness component, calculate brightness information based on the histogram distribution, and generate a digital adaptive brightness control signal based on backlight driving data representative of the brightness information, the backlight driving data including a digital signal that controls a driving power, a driving voltage and a driving current of the backlight a second processor structured to convert the digital adaptive brightness control signal into a analog adaptive brightness control signal, decrease the analog adaptive brightness control signal to generate a plurality of low brightness control voltages, the low brightness control voltages being different from one another, increase the analog adaptive brightness control signal to generate a plurality of high brightness control voltages, the high brightness control voltages being different from one another and selectively output one of the low brightness control voltages and the high brightness control voltages in response to an external brightness control signal; and an inverter coupled to the second processor and a backlight, the inverter driving the backlight according to the selected brightness control voltage.

6. The device of claim 5, wherein the external brightness control signal is an user input provided to the second processor via a user interface.

7. The device of claim 5, wherein the second processor comprises a plurality of resistors, the low brightness control voltages being generated from a plurality of nodes between the resistors.

8. The device of claim 7, wherein the low brightness control voltages are smaller than the analog adaptive brightness control signal.

9. The device of claim 5, wherein the second processor comprises a plurality of amplifiers, the high brightness control voltages being generated from the amplifiers.

10. The device of claim 9, wherein the high brightness control voltages are larger than the analog adaptive brightness control signal.

11. The device of claim 5, wherein the brightness information which includes at least one of a maximum brightness, a minimum brightness, or an average brightness.

12. The device of claim 11, wherein the first processor further comprises a histogram modulator which generates a modulated brightness component based on the brightness information and the first processor generates output video data which are modulated to have an increased histogram distribution based on the modulated brightness component.

13. The device of claim 12, wherein the input video data of a low gray scale is processed to the output video data of the lower gray scale, and the input video data of a high gray scale is processed to output the output video data of a higher gray scale.

14. The device of claim 12, wherein the first processor further generates a modified timing signal which is synchronized according to the output video data having the increased histogram distribution.

* * * * *

UNITED STATES PATENT AND TRADEMARK OFFICE

CERTIFICATE OF CORRECTION

PATENT NO. : 8,212,764 B2
APPLICATION NO. : 11/895520
DATED : July 3, 2012
INVENTOR(S) : Hong Sung Song et al.

It is certified that error appears in the above-identified patent and that said Letters Patent is hereby corrected as shown below:

In the Claims

In column 8, claim 3, line 48, after "claim 1, wherein" replace "the the high" with --the high--.

Signed and Sealed this
Eighteenth Day of September, 2012

David J. Kappos

David J. Kappos
*Director of the United States Patent and Trademark Office*